United States Patent [19]

Bachner et al.

[11] 4,012,997

[45] Mar. 22, 1977

[54] METHOD FOR FORMING A LIQUID-TIGHT FLAT TOP CONTAINER

[75] Inventors: George L. Bachner; Jerry G. Bachner, both of Barrington, Ill.

[73] Assignee: Nimco Corporation, Crystal Lake, Ill.

[22] Filed: Aug. 6, 1975

[21] Appl. No.: 602,286

Related U.S. Application Data

[62] Division of Ser. No. 488,852, July 15, 1974.

[52] U.S. Cl. ..... 93/36.8; 93/44.1 GT

[51] Int. Cl.[2] ..... B31B 1/26

[58] Field of Search ..... 93/36.8, 44.1 GT; 53/373, 374, 375, 381 R, 39; 93/53 M, 53 R, 49 R, 49 M

[56] References Cited

UNITED STATES PATENTS

| | | | |
|---|---|---|---|
| 2,070,838 | 2/1937 | Örström | 93/36.8 X |
| 3,263,391 | 8/1966 | Wallsten | 93/44.1 GT UX |
| 3,762,132 | 10/1973 | Owen | 93/44.1 GT X |
| 3,890,765 | 6/1975 | Farfaglia et al. | 53/375 X |
| 3,910,014 | 10/1975 | Braun | 53/373 |

*Primary Examiner*—James F. Coan
*Attorney, Agent, or Firm*—Kirkland & Ellis

[57] ABSTRACT

A new carton blank uniquely scored and a method of folding for a liquid-tight flat top container is disclosed. The scoring pattern and tab configuration of the carton makes possible the formation of a modified gable top container the top of which is subsequently folded into the horizontal plane and held in that position leaving a flat top closure. The carton blank is shaped and scored for folding into substantially a gable top container. An additional score line extending across one of the two roof panels and its associated triangular fold-in tabs facilitates the folding of the modified gable top into a horizontal (flat top) position. In the preferred embodiment the modified gable top, after folding, is held in its horizontal (flat top) position by a bond formed between an extension of one of the sealing tabs and one of the roof panels of the modified gable top. The sealing tab extension is attached to the remainder of the carton by a perforated section of the carton blank to allow one desiring to open the flat top container to tear along the perforation and fold the modified gable top into its pour spout position. In an alternative embodiment the bond holding the modified gable top in its horizontal position is created between a single conventional sealing tab and one of the roof panels of the modified gable top. In this second embodiment, one desiring to open the carton need only break the bond, and fold the modified gable top into its pour spout position.

2 Claims, 14 Drawing Figures

METHOD FOR FORMING A LIQUID-TIGHT FLAT TOP CONTAINER

This is a division of application Ser. No. 488,852, filed July 15, 1974.

BACKGROUND OF THE INVENTION

1. Field of the Invention

This invention generally relates to paper board containers and more particularly this invention relates to leak proof paperboard containers examples of which are disposable containers adapted for distribution of milk and other diary products.

2. Description of the Prior Art

Over the past two decades the paperboard container industry has seen much development and rapid change. Developments in the milk carton and dairy product container industry have been in the forefront. Historically, paperboard containers were adapted for fluids by applying paraffin to the paperboard carton as a coating. As improved methods for use of plastic developed, the container industry saw the marriage of plastic and paper replacing the paraffin coating technique as a means for creating a liquid-tight carbon.

Paralleling developments relating to carton material have been numerous improvements and innovations with respect to carton configuration and design. The milk packaging industry for example has seen numerous cartons of various shapes and sizes come and go. Because of its functional qualities, however, the gable top pour spout container has grown steadily in popularity and now dominates the milk packaging industry. The two most notable functional qualities of the gable top carton are the ease with which the pour spout can be folded into its pouring position and the effectiveness of the pour spout as a means for pouring liquid from the carton.

There have been several improvements in the gable top carton over the past decade including variations in the scoring pattern and advancements in folding and sealing techniques.

Despite these improvements the gable top carton, due to its peaked top closure, and the consequent inability to stack one such carton atop another has always posed shipping and display problems. Because of its physical shape the gable top carton gives rise to a substantial loss of space economy during shipping and while on display. The awkward stacking characteristics of the gable top carton also burden the consumer both while shopping and subsequently during storage prior to use in the home refrigerator.

There have been several attempts to obviate this basic shortcoming by the creation of cartons having squared or flat tops. Early square top configurations employed peculiar pouring orifices which in most cases where complex and never achieved wide acceptance. One such flat top paper carton is illustrated in U.S. Pat. No. 2,926,832—Negoro. There were also attempts to create square top cartons having fold out pour spouts as for example U.S. Pat. No. 2,337,730 Berch and U.S. Pat. No. 3,081,927 Hayhurst. These and other flat top fluid containers have not been acceptable due both to the difficulty and cost of creating such containers and to functional inadequacies of such containers.

At the present time there is no carton which overcomes the stacking drawbacks of the gable top container while preserving the beneficial characteristics and widely accepted pour spout configuration of that carton.

The present invention obviates the deficiencies of the prior art including the above noted problems of the widely accepted gable top carton by providing a new carton blank uniquely scored and a method of folding the carton blank to create a liquid-tight flat top container having a pour spout identical to that of the conventional gable top container.

SUMMARY OF THE INVENTION

The present invention comprises a new carton blank with a unique scoring pattern and a method of folding the carton blank to create a flat top container with a pour spout.

The paperboard carton blank of the present invention is substantially similar to the carton blank of the conventional gable top carton but in the preferred embodiment an additional tab is attached by a perforated section of paperboard to, and coextensive with, one of the two sealing tabs. The additional tab is bonded to one of the roof panels of the carton after folding and functions to hold the carton top in its flat top configuration.

The scoring pattern for the carbon blank of the present invention is substantially similar to the scoring pattern for the conventional gable top carton except the carton blank of the present invention has an additional scoring line running horizontally across one of the roof panels and its two associated triangular fold-in tabs. The added score line facilitates a new fold whereby the top closure of the carton is made flat.

The flat top carton of the present development is created by first folding the scored carton blank into a sealed modified gable top configuration substantially in steps well known in the art.

While the carton is in the modified gable top configuration, the new score line appears running horizontally across one of the roof panels substantially parallel with and between the bottom edge of the mated sealing tabs and the top edge of the side panel associated with the scored roof panel. With the exception, in the preferred embodiment, of the additional tab extention protruding upward from the mated sealing tabs and the new score line, the top closure at this intermediate stage takes on the appearance of the top closure of the conventional gable top container.

To create a flat top in accordance with the present development, a force directed against and substantially perpendicular to the scored sloping roof panel is applied along the new scoring line causing the subject roof panel to fold along the score line. As additional force is applied the fold becomes more pronounced and the gable top tends towad a flat configuration with the mated sealing tabs and the new tab extension assuming a position above the new score line.

In this position heat is applied to the surfaces of the new tab extension and the infolded roof panel melting the thermo-plastic coatings. With the thermo-plastic coatings thus melted, the modified gable top is completely collapsed by application of a second force which presses the heated surfaces together. As the pressed heated surfaces are cooled a bond is formed between the thermo-plastic coating of the new tab extension and the thermo-plastic coating of the infolded roof panel. The tab extension thus bonded holds the carton top in its horizontal position and the liquid-tight flat top container is complete.

A hot melt adhesive may be applied to one or both of the surfaces to be joined as an alternative to the foregoing heating step after which the top closure is completely collapsed and held in its horizontal (flat top) position by the bonded tab extension in a manner similar to that described above.

To open the flat top container of the present development the mated sealing tabs are torn from the bonded tab extension along the perforated section of paperboard and the carton top is returned to its modified gable top configuration after which the pour spout is positioned for pouring in the conventional manner.

In the alternative embodiment the tab extension is omitted and the modified gable top is folded as described with reference to the preferred embodiment and held in its horizontal (flat top) position by means of a bond formed between one of the mated sealing tabs and the roof panel against which it is pressed.

To open the carton of the alternative embodiment the mated sealing tabs are torn free from the roof panel to which they are bonded and the carton is returned to its modified gable top configuration after which the pour spout is positioned for use in the usual manner.

It is an object of the present invention to preserve the beneficial pour spout features of the gable top container while providing a flat top closure to obviate the shipping and display deficiencies characteristic of the conventional gable top container.

It is a further object of the present invention to provide a scoring pattern for a flat top carton having a pour spout identical to that of the gable top carton.

Another object of the present invention is to provide an easy means for opening the flat top carton.

Yet another object of the present invention is to teach a method for folding to create a flat top carton having all the beneficial characteristics of the well known conventional gable top carton.

Other objects and advantages of the present invention will be apparent from the following descriptions and accompanying drawings of the preferred embodiment of the present invention.

DESCRIPTION OF THE PREFERRED EMBODIMENT

Figure 1:
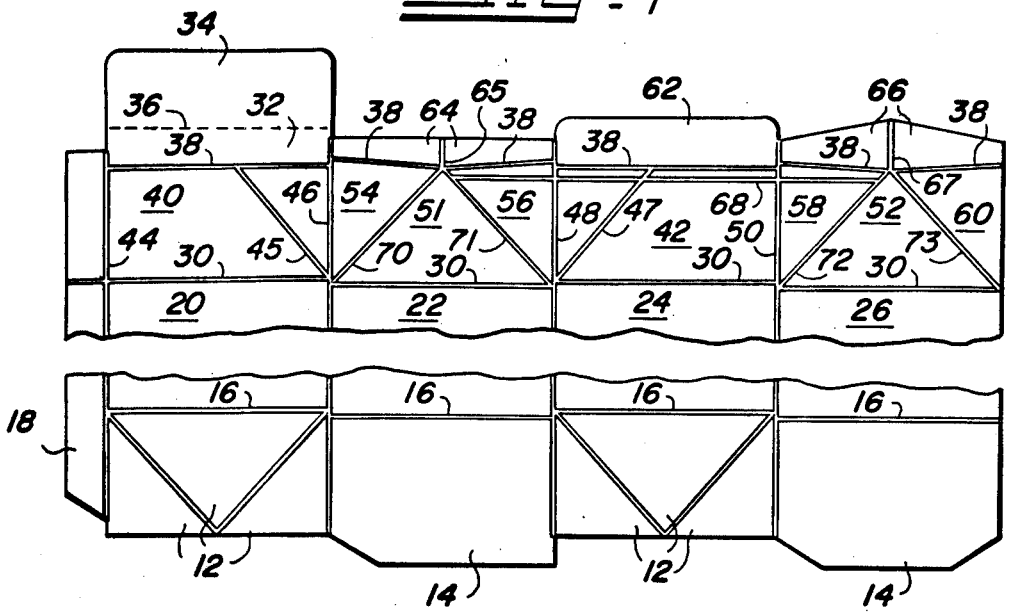
FIG. 1 is a top plan view of the carton blank and scoring patten of the preferred embodiment of the present invention.

Referring to FIGS. 1–10 and more particularly to FIG. 1, carton blank 10 comprises conventional bottom closure tabs 12 and panels 14 all of which are separated from the top closure of carton blank 10 by staggered score line 16 and wall panels 20, 22, 24 and 28 with side seam tab 18. The present invention is directed to the top closure of the carton and accordingly a detailed description of the bottom closure tabs 12 and panels 14 along with side seam tab 18 and wall panels 20, 22, 24 and 26 is not necessary for a complete description of the present invention. Top closure 28 of carton blank 10 may of course be adapted for use with any one of a number of known four wall carton configurations. A satisfactory bottom closure and wall panel configuration and scoring pattern is disclosed in FIG. 1 of U.S. Pat. No. 3,120,222 —Seiple issued Feb. 14, 1964.

Figure 5:
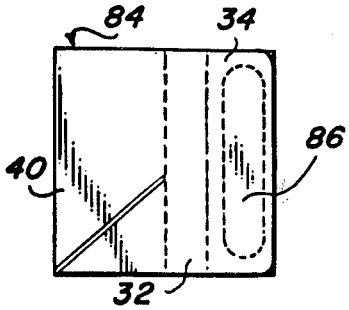
FIG. 5 is a top plan view of the flat top carton showing the carton top bonded in its horizontal (flat top) position.

Top closure 28, comprising that portion of carton blank 10 lying above staggered score line 30, has a peripheral shape substantially similar to that shown in FIG. 5 of U.S. Pat. No. 3,116,002 —Crawford issued Dec. 31, 1963 except that sealing tab 32 has been extended by an additional tab portion 34 which is integral with and coextensive of sealing tab 32. Perforated segment 36 defines the boundary of tab extension 34 with respect to the remainder of carton blank 10 and functions to facilitate the tearing of sealing tab 32 from tab extension 34 to effect opening of the carton as will be explained more fully below.

With reference to FIG. 1, carton top closure 28 of carton blank 10 is bounded on the bottom by staggered score line 30 and is divided laterally by broken score line 38. The components of top closure 28 include roof panels 40 and 42 bounded at the top and bottom respectively by broken score line 38 and staggered score line 30. Roof panel 40 comprises that portion of top closure 28 lying between score lines 44 and 46. Similarly, roof panel 42 is bounded on its left and right edges respectively by score lines 48 and 50. The remainder of that portion of top closure 28 lying between broken score line 38 and staggered score line 30 comprises triangular end tabs 51 and 52 and triangular fold-in tabs 54 through 60. Triangular fold-in tabs 54 and 56 are attached to triangular end tab 51 along diagonal score lines 70 and 71. Similarly, triangular fold-in tabs 58 and 60 are attached to triangular end tab 52 by diagonal score lines 72 and 73.

The components of carton top closure 28 (FIG. 1) lying above broken score line 38 include sealing tabs 32 and 62, tab extension 34, lip tabs 64 and shim tabs 66. Lip tabs 64 and shim tabs 66 are divided respectively by vertical score lines 65 and 67.

The tab group consisting of triangular fold-in tabs 54 and 56, lip tabs 64 and triangular end tab 51 forms a pouring spout in the conventional manner when the sealed carton is opened. Diagonal score lines 45 and 47 across roof panels 40 and 42 respectively facilitate the opening of the sealed carton and withdrawal of the carton pour spout.

The scoring patten of top closure 28 also includes top fold score line 68 extending from score line 71 of triangular fold-in tab 56 across roof panel 42 to score line 72 of triangular fold-in tab 58 substantially parallel to, but distinct from, broken score line 38. Top fold score line 68 functions to facilitate the folding of the modified gable top (FIG. 6) to its flat top configuration (FIG. 9) in the manner described in detail below. The distance between broken score line 38 and top fold score line 68 as will become clear from the following discussion varies with the distance between staggered score line 30 and broken score line 38 and with the thickness of the paperboard from which carton blank 10 is created.

Figure 2:
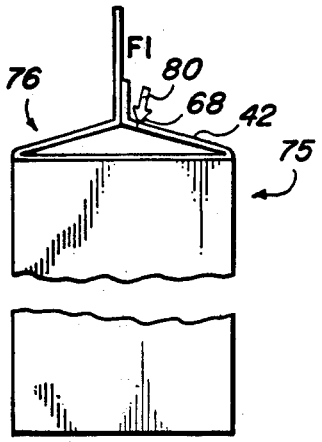
FIG. 2 is a left side elevation view of the present invention in its intermediate modified gable top configuration before final folding.
Figure 6:
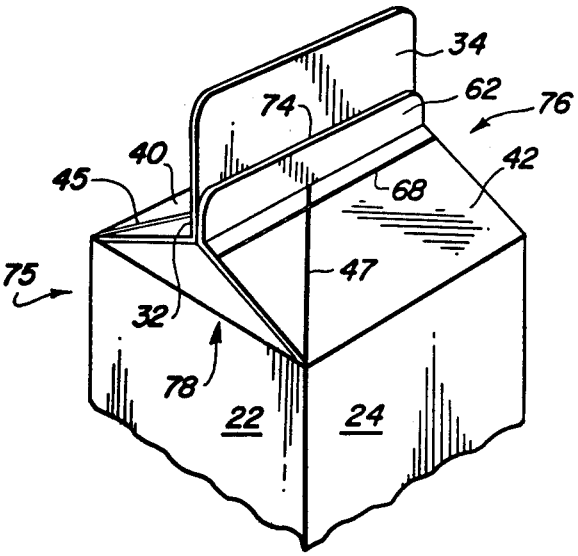
FIG. 6 is a perspective view of a carton in accordance with the present invention in its intermediate modified gable top configuration before final folding.
Figure 7:
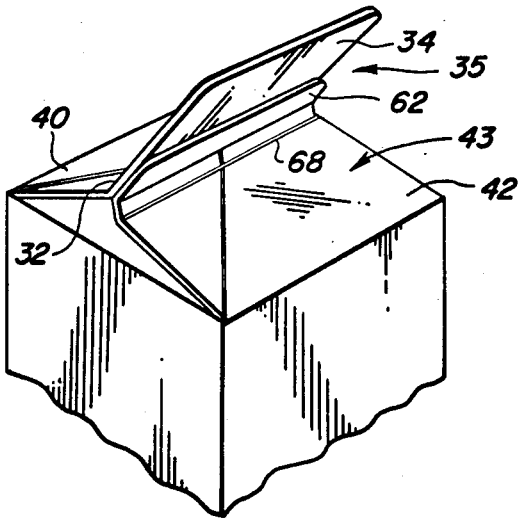
FIG. 7 is a perspective view of a carton in accordance with the present invention during final folding.
Figure 8:
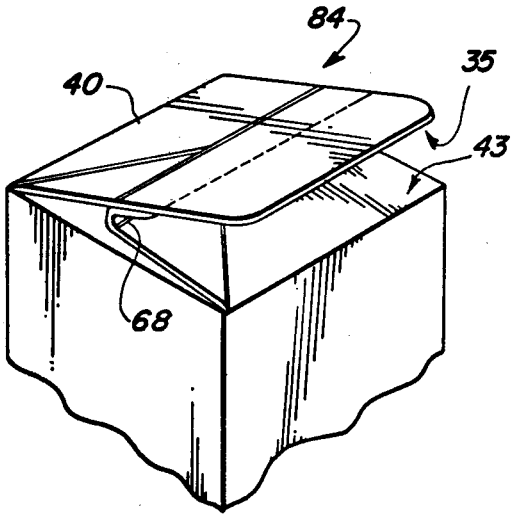
FIG. 8 is a perspective view of a carton in accordance with the present invention just prior to forcing the carton top to its horizontal (flat top) position.
Figure 9:
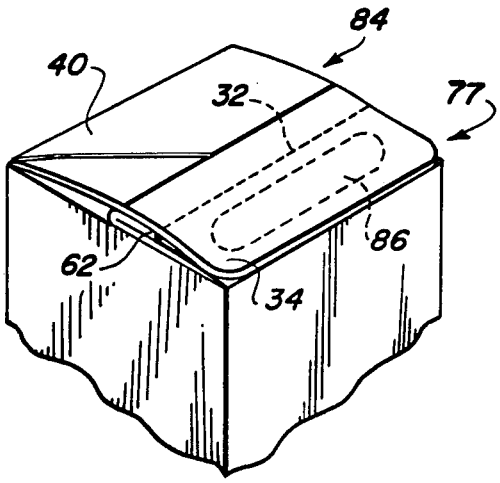
FIG. 9 is a perspective view of the top closure of a carbon formed in accordance with the present invention.

With reference to FIG. 9, flat top carton 77 is created by first folding carton blank 10 (FIG. 1) in a conventional manner to form the modified gable top carton 75 shown in FIGS. 2 and 6.

With reference to FIG. 6, modified gable top 76 of modified gable top carton 75 comprises roof panels 40 and 42 held in their intermediate sloping position by the mating engagement of sealing tabs 32 and 62. Tab extension 34 is shown extending upward in the verticle direction from sealing tab 32 to which it is attached by perforated segment 36 (not shown).

A liquid-tight seal is formed along mating line 74 of modified gable top 76 by bonding sealing tabs 32 and 62 in accordance with conventional ultrasonic or heat techniques. It is preferably, with the present development, however, to use ultrasonic techniques to bond the sealing tabs to form a liquid-tight seal thereby eliminatine one heating and cooling step.

The left end 78 of the modified gable top 76 (FIG. 6) is of course, adapted for partially breaking the bond along mating line 74 in the conventional gable top manner to allow withdrawal of the infolded pour spout (not shown).

For initial shipment, display and storage prior to opening, the modified gable top 76, in accordance with the present invention, is folded along top fold score line 68 of roof panel 42 (FIG. 6) as described below to form the flat top carton 77 shown in FIG. 9.

With reference to FIG. 2, the modified gable top 76 of modified gable top carton 75 (see also FIG. 6) is subjected to a force F1 acting substantialy in the direction of arrow 80 along top fold score line 68 (top fold score line 68 appears in FIG. 2 as a point). As force F1 is applied, roof panel 42 (shown as an edge in FIG. 2) bends along top fold line 68 to the position shown by dashed lines in FIG. 3 and in perspective in FIG. 7. As the fold along top fold score line 68 becomes more pronounced the direction of force F1 is adjusted toward the horizontal and mated sealing tabs 32 and 62 and tab extension 34 tend toward and over top fold score line 68 and toward a coplainer position with roof panel 40 (see FIGS. 3, 7 and 8).

Figure 3:
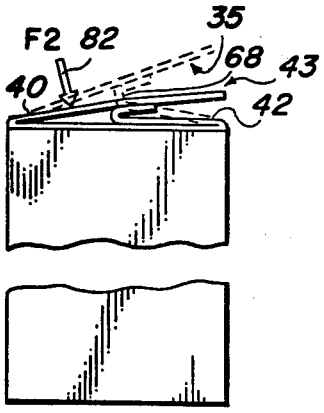
FIG. 3 is a left side elevation view showing the present invention during folding.
Figure 4:
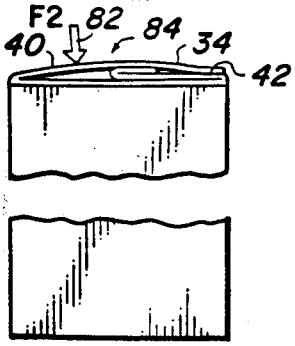
FIG. 4 is a left side elevation view showing the carton top in its horizontal (flat top) position with the new tab extension bonded to the infolded roof panel of the carton.

With the top closure in its FIG. 3 dashed line configuration (see also FIG. 7) surfaces 35 and 43 are heated until the thermo-plastic coating thereon is melted. With surfaces 35 and 43 thus heated, a second force F2 acting substantially in the direction of arrow 82 is applied and folding resumes and progresses to the stage illustrated in FIG. 3 (solid lines) and FIG. 8. As force F2 is further applied, the surfaces 35 and 43 respectively of tab extension 34 and infolded roof panel 42 are brought into contact and allowed to cool forming a thermo-plastic bond substantially at area 86 (FIG. 5). The bond thus formed holds modified gable top 76 in its horizontal (flat top) position 84 (FIG. 4).

As an alternative to the heating of surfaces 35 and 43 at the FIG. 3 (dashed line) stage to form a thermoplastic bond between tab extension 34 and infolded roof panel 42, a hot melt adhesive may be applied to either or both surfaces 35 and 43. With the hot melt adhesive thus applied, the final folding progresses as described above and a bond is formed in substantially area 86 (FIG. 4) as the hot melt adhesive hardens holding modified gable top 76 in its horizontal (flat top) position 84 and liquid-tight flat top container 77 (FIG. 9) is complete.

With reference to FIG. 9, to open liquid-tight flat top container 77, mated sealing tabs 32 and 62 are torn from tab extension 34 along perforated carton portion 36 and the top closure is returned to its modified gable top 76 configuration (FIG. 6) by pulling upward on mated sealing tabs 32 and 62. Referring to FIG. 6, with the carton in modified gable top 76 configuration (tab extension 34 is shown in FIG. 6 attached to sealing tab 32 but would of course during opening of the carton be torn free of sealing tab 32 and attached to roof panel 42) roof panels 40 and 42 are folded back along score lines 45 and 47 and the carton pour spout of modified gable top 76 is withdrawn for use in the convention manner.

As stated previously with reference to FIG. 1, the position of top fold score line 68 with respect to broken score line 38 is a function of the modified gable top height (geometry) and the thickness of the paperboard used to fabricate the carton. As, for example, when the modified gable top height is decreased (a result obtained by decreasing the distance between staggered score lines 30 and broken score lines 38) the distance between top fold score line 68 and broken score line 38 is decreased. As the distance between broken score line 38 and staggered score line 30 approaches one-half the distance between score lines 46 and 48 (the carton width) top fold score line 68 approaches broken score line 38. If that distance is made equal to one-half the carton width, top fold score line 68 is superimposed over broken score line 38. As the modified gable top height is decreased, however, there are consequent sacrifices in the advantages and favorable characteristics of the modified gable top. With reference to FIG. 1, for the dimensions of the conventional gable top pour spout, top fold score line 68 is positioned on a full scale one court carton blank approximately 3/16 of one inch below broken score line 38 measured on roof panel 42. This distance will of course increase slightly as the weight (thickness) of the paperboard used for the carton blank is increased.

Figure 10:
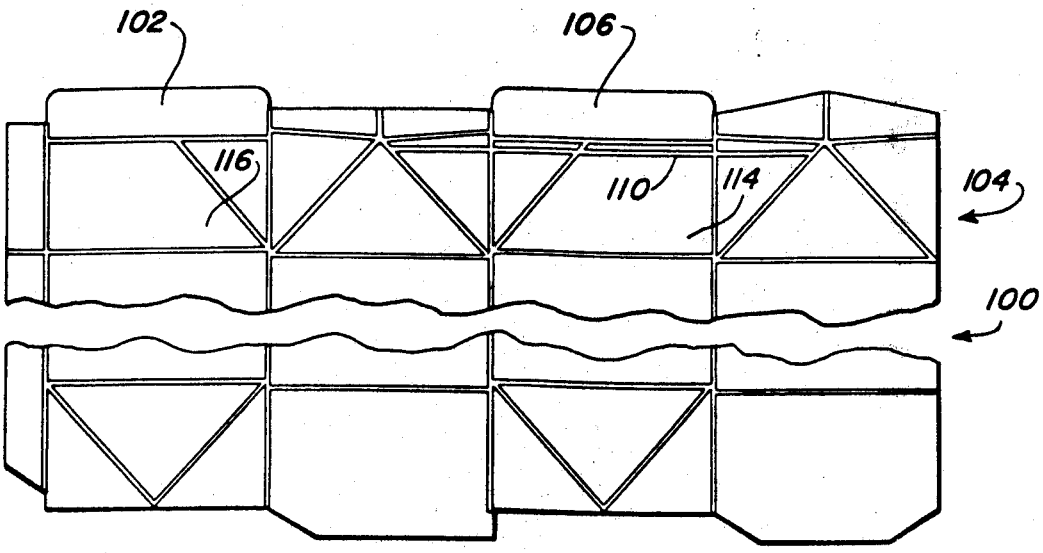
FIG. 10 is a top plan view of a carton blank and scoring pattern of the alternative embodiment of the present invention.
Figure 9:
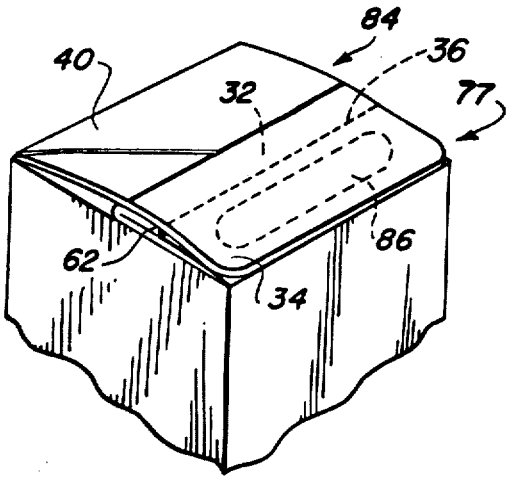
Figure 11:
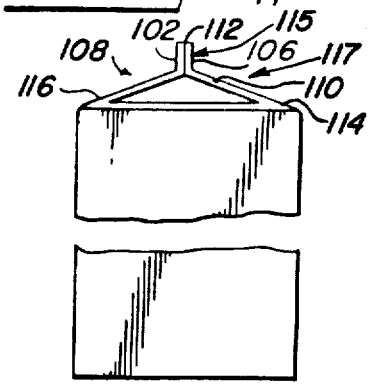
Figure 12:
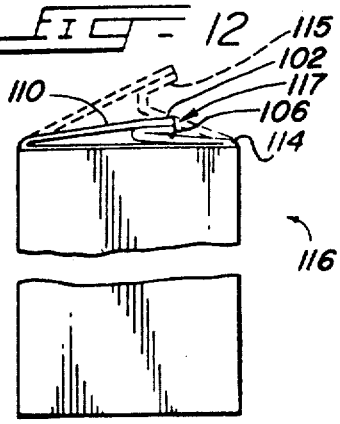

Referring now to FIGS. 10 through 14, and more particularly to FIG. 10, carton blank 100 is identical to carton blank 10 of FIG. 1 with the exception of sealing tab 102 which has no counterparts to tab extension 34 or perforated section 36 (see FIG. 1). With the exception of this difference, the top closure 104 of carton blank 100 is shaped and scored the same as carton blank 10 of FIG. 1 and the disclosure directed to FIG. 1 is generally applicable to FIG. 10.

Figure 11:
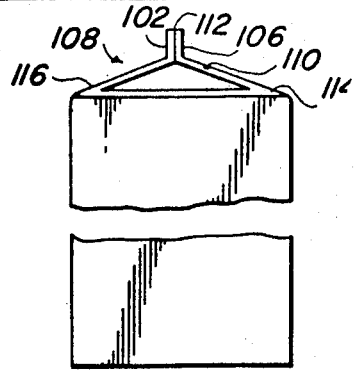
FIG. 11 is a left side elevation view of a carton in accordance with the alternative embodiment in its intermediate modified gable top configuration before final folding.
Figure 12:
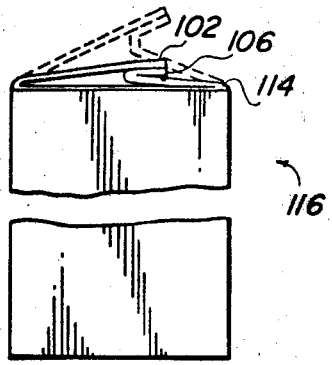
FIG. 12 is a left side elevation view of a carton in accordance with the alternative embodiment of the present invention during final folding.

With reference to FIGS. 11 and 12 in the manner described with respect to the prefered embodiment, carton blank 100 is first folded to form modified gable top 108 with sealing tabs 102 and 106 bonded together by conventional heating or ultrasonic techniques to form a liquid-tight seal along interface 112. Following the formation of the liquid-tight seal along interface 112, a force is applied to top fold score line 110 (shown in FIGS. 11 and 13 as a point) followed by the heating of the surfaces to be bonded or alternately the application of a holt melt adhesive to the surfaces to be bonded. A second force acting on the top surface 114 of modified top 108 is applied and modified gable top 108 is folded to its horizontal (flat top) position (FIG. 13) and bonded in the manner described with respect to the preferred embodiment.

There being no counterpart in the alternative embodiment to the preferred embodiment tab extension 34, heat or hot melt adhesive is applied to contact surfaces 115 and 117 (FIG. 11) of the mated sealing tabs 102 and 106 contact surfaces 115 and 117 are then pressed together and held after infolded roof panel 114, is folded to its horizontal (flat top) position forming a bond which holds the modified gable top in its horizontal (flat top) position until opened.

Figure 13:
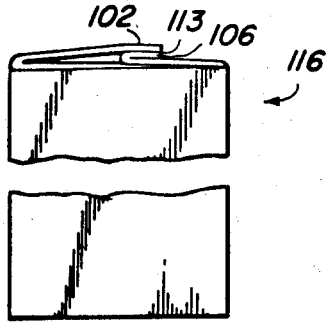
FIG. 13 is a left side elevation view of a carton in accordance with the alternative embodiment of the present invention in its final flat top configuration.
Figure 14:
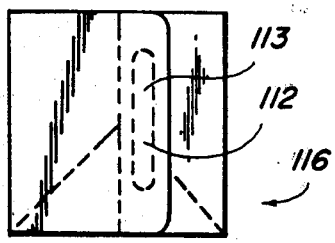
FIG. 14 is a top plan view of a flat top carton showing the carton top bonded in its horizontal (flat top) position.

With reference to FIGS. 13 and 14, to open the liquid-tight flat top container, bond 113 between sealing tab 106 and roof panel 114 is broken and the carton top closure is returned to its modified gable top 108 position (FIG. 11). Thereafter the liquid-tight bond along interface 112 is partially broken and the pour spout of modified gable top 108 is positioned for pouring in the conventional manner.

The embodiments disclosed could of course, be used in connection with any size carton and for dry goods or liquids but are intended primarily for standard milk cartons ranging in size from ¼ pint to 1 gallon.

It will of course be appreciated by those skilled in the art that the present invention is not limited to the precise embodiments or methods disclosed. For example, other techniques such as the application of glue or other bonding materials may be used in place of the thermo-plastic bond and hot melt adhesive described to hold the carton top closure in its horizontal position. Similarly the carton blank may be composed of material other than the thermo plastic coated paperboard customarily used for liquid containers such as milk cartons.

Various additional changes, modifications and variations could also be made in the carton blank, scoring pattern and methods disclosed herein without departing from the scope and spirit of the present invention.

We claim:

1. A method for forming a flat top closure for a conventional paper carton, said conventional paper carton comprising four substantially rectangular wall panels having a bottom closure forming a liquid-tight tubular container wherein the method comprises the steps of:

cutting a blank of foldable sheet material for forming a conventional tubular container with substantially a gable top pattern;

scoring the blank of foldable sheet material with a conventional gable top fold pattern;

scoring the blank of foldable sheet material with a top fold score line running across and parallel to the top edges of one of the conventional rectangular roof panels and across the two triangular fold-in tabs immediately adjacent to said one of the conventional rectangular roof panels;

forming the blank of foldable material into a conventional gable top container with sloping roof panels, and mated sealing tabs extending vertically from the slanting roof panels with said top fold score line appearing on said one of the conventional rectangular roof panels;

folding said one of the conventional rectangular roof panels of said conventional gable top container inward along said top fold score line;

heating the thermo-plastic surfaces of one of the conventional rectangular roof panels and said mated sealing tabs;

forcing said top fold score line downward and toward the other roof panel of said conventional gable top container until the other roof panel lies in a plane substantially perpendicular to the four substantially rectangular wall panels above said one of the conventional rectangular roof panels;

pressing said other roof panel and said mated sealing tabs downward until said other roof panel and said mated sealing tabs lie in contact with said one of the conventional rectangular roof panels in a plane substantially perpendicular to the four substantially rectangular wall panels above said one of the roof panels;

holding at least one of said mated sealing tabs in contact with said one of the conventional rectangular roof panels until their heated thermo-plastic surfaces cool forming a bond between the thermo-plastic surfaces of at least one of said mated sealing tabs and said one of the roof panels thereby holding said other roof panel and said mated sealing tabs in a plane substantially perpendicular to the four substantially rectangular wall panels above said one of the conventional rectangular roof panels resulting in a flat liquid-tight top closure.

2. A method for forming a flat top closure for a conventional paper carton, said conventional paper carton comprising four substantially rectangular wall panels having a bottom closure forming a liquid-tight tubular container wherein the method comprises the steps of:

cutting a blank of foldable sheet material for forming a conventional tubular container with substantially a gable top pattern;

scoring the blank of foldable sheet material with a conventional gable top fold pattern;

scoring the blank of foldable sheet material with a top fold score line running across and parallel to the top edge of one of the conventional rectangular roof panels and across the two triangular fold-in tabs immediately adjacent to said one of the conventional rectangular roof panels;

forming the blank of foldable material into a conventional gable top container with sloping roof panels, and mated sealing tabs extending vertically from the slanting roof panels with said top fold score line appearing on said one of the conventional rectangular roof panels;

folding said one of the conventional rectangular roof panels of said conventional gable top container inward along said top fold score line;

applying a hot melt adhesive to at least one of the surfaces of said one of the conventional rectangular roof panels and said mated sealing tabs;

forcing said top fold score line downward and toward the other roof panel of said conventional gable top container until the other roof panel lies in a plane substantially perpendicular to the four substantially rectangular wall panels above said one of the conventional rectangular roof panels;

pressing said other roof panel and said mated sealing tabs downward until said other roof panel and said mated sealing tabs lie in contact with said one of the conventional rectangular roof panels in a plane substantially perpendicular to the four substantially rectangular wall panels above said one of the roof panels;

holding at least one of said mated sealing tabs in contact with said one of the conventional rectangular roof panels until the hot melt adhesive cures forming a bond between the thermo-plastic surfaces of at least one of said mated sealing tabs and said one of the roof panels thereby holding said other roof panel and said mated sealing tabs in a plane substantially perpendicular to the four substantially rectangular wall panels above said one of the conventional rectangular roof panels resulting in a flat liquid-tight top closure.

* * * * *

UNITED STATES PATENT OFFICE

CERTIFICATE OF CORRECTION

Patent No. 4,012,997 Dated March 22, 1977

Inventor(s) George L. Bachner and Jerry G. Bachner

It is certified that error appears in the above-identified patent and that said Letters Patent are hereby corrected as shown below:

Column 1, line 25, "carbon" should read --carton--.

Column 2, line 25, "carbon" should read --carton--.

Column 4, line 2, "carbon" should read --carton--.

Column 5, line 41, "preferably" should read --preferable--.

Column 7, line 18, after "modified" (first occurence) insert --gable--.

Column 8, line 3, "edges" should read --edge--.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 4,012,997 Dated March 22, 1977

Inventor(s) George L. Bachner et al.

It is certified that error appears in the above-identified patent and that said Letters Patent are hereby corrected as shown below:

Column 3, line 47, "patten" should read --pattern--

Column 5, line 44, "eliminatine" should read --eliminating--.

Column 6, line 60, "court" should read --quart--

In the drawings, Figures 9, 11 and 12 should appear as shown on the attached page.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*